US010906774B1

(12) United States Patent
Akin

(10) Patent No.: US 10,906,774 B1
(45) Date of Patent: Feb. 2, 2021

(54) APPARATUS FOR ELEVATOR AND LANDING ALIGNMENT

(71) Applicant: Scott Akin, Kinnelon, NJ (US)

(72) Inventor: Scott Akin, Kinnelon, NJ (US)

( * ) Notice: Subject to any disclaimer, the term of this patent is extended or adjusted under 35 U.S.C. 154(b) by 0 days.

(21) Appl. No.: 16/891,503

(22) Filed: Jun. 3, 2020

(51) Int. Cl.

| | |
|---|---|
| ***B66B 1/40*** | (2006.01) |
| ***B66B 1/28*** | (2006.01) |
| ***B66B 13/16*** | (2006.01) |
| ***B66B 1/50*** | (2006.01) |

(52) U.S. Cl.
CPC ..... *B66B 1/40* (2013.01); *B66B 1/28* (2013.01); *B66B 1/50* (2013.01); *B66B 13/165* (2013.01)

(58) Field of Classification Search
CPC .... B66B 1/40; B66B 1/42; B66B 1/36; B66B 13/301; B66B 5/0031; B66B 5/0018
USPC ..... 187/284
See application file for complete search history.

(56) References Cited

U.S. PATENT DOCUMENTS

| | | | | |
|---|---|---|---|---|
| 958,542 | A | 5/1910 | Ricketts | |
| 1,376,849 | A | 5/1921 | Winter | |
| 2,924,682 | A | 2/1960 | Winterburn | |
| 3,040,295 | A | 6/1962 | Linville | |
| 3,975,723 | A | 8/1976 | Bowling et al. | |
| 4,094,266 | A | 6/1978 | Artt | |
| 4,245,721 | A | 1/1981 | Masel | |
| 4,275,274 | A | 6/1981 | English | |
| 4,750,592 | A * | 6/1988 | Watt | B66B 1/3492 187/394 |
| 4,785,914 | A | 11/1988 | Blain et al. | |
| 5,641,221 | A | 6/1997 | Schindele et al. | |
| 5,659,159 | A | 8/1997 | Koopman, Jr. | |
| 5,896,953 | A | 4/1999 | Horne et al. | |
| 5,918,705 | A | 7/1999 | Friend | |
| 6,006,866 | A | 12/1999 | Horne et al. | |
| 6,050,368 | A * | 4/2000 | Pakarinen | B66B 1/30 187/293 |
| 6,220,396 | B1 | 4/2001 | Heath, III | |
| 6,526,368 | B1 * | 2/2003 | Coste | B66B 1/40 187/284 |
| 6,543,583 | B1 | 4/2003 | Lence Barreiro et al. | |
| 6,701,277 | B2 | 3/2004 | Coste et al. | |
| 7,677,364 | B2 | 3/2010 | Begle | |
| 8,201,665 | B2 * | 6/2012 | Gieras | F01N 3/2864 187/315 |
| 8,678,140 | B2 | 3/2014 | Gieras et al. | |
| 8,960,372 | B2 | 2/2015 | Heath et al. | |
| 9,567,188 | B2 * | 2/2017 | Huff | B66B 1/3492 |
| 2002/0193963 | A1 | 12/2002 | Coste et al. | |
| 2009/0120730 | A1 | 5/2009 | Begle | |
| 2010/0320036 | A1 | 12/2010 | Ferreira | |
| 2017/0029246 | A1 | 2/2017 | Kulak et al. | |
| 2017/0197804 | A1 * | 7/2017 | Kattainen | B66B 1/30 |
| 2019/0359451 | A1 | 11/2019 | Fang et al. | |
| 2020/0109026 | A1 * | 4/2020 | Birrer | B66B 1/3492 |

FOREIGN PATENT DOCUMENTS

| | | | |
|---|---|---|---|
| WO | 2008105871 | A1 | 2/2007 |

* cited by examiner

*Primary Examiner* — Christopher Uhlir
(74) *Attorney, Agent, or Firm* — The McHattie Law Firm, LLC

(57) ABSTRACT

An elevator alignment system providing alignment between respective sills of an elevator car and an entrance landing to/from which the cab is scheduled, via alignment members disposed with the sills.

15 Claims, 6 Drawing Sheets

APPARATUS FOR ELEVATOR AND LANDING ALIGNMENT

FIELD OF THE DISCLOSURE

Disclosed embodiments relate to elevator alignment with an intended landing, and more specifically, to such alignment actuating opening of each of the elevator car door and a respective landing door so as to permit passage into and out of the elevator.

BACKGROUND

Positioning between an elevator car and its intended landing has been, and continues to be, a focus of manufacturers, regulators, and the public at large. This is especially the case as architectural design and capacity enables the construction of an ever increasing number of high-rise buildings featuring commensurate high-speed elevator travel between floors thereof.

Whether in the context of these or other types of buildings, the focus on the aforementioned positioning has been guided by the desire to appropriately enable entry into and exiting from an elevator car. Efforts in this regard have sought to optimize techniques including advanced car door opening and car leveling. Advanced car door opening provides for beginning the opening of the elevator car door prior to the elevator car fully reaching alignment with the landing at a respective floor. Car leveling refers to reaching a nearest proximity of the elevator car with the landing to which the approach of the elevator car is scheduled or intended.

Various systems exist for achieving the aforementioned car leveling. For example, an encoder may be equipped to travel with the elevator car and to coordinate positioning and leveling of the elevator car via sensing of position delineations on veins disposed in the elevator hoistway. As another example, a positioning tape may be disposed along the entirety of the hoistway. In this regard, at least two forms of the positioning tape provide for an ability to obtain a determination of the position of the elevator car. Firstly, the positioning tape may be perforated wherein such perforations accommodate reading thereof by sensors of a landing unit disposed on the elevator car. The landing unit includes a series of tape guides enabling the landing unit to travel along the positioning tape so that sensor readings may be used to determine positioning of the elevator car. Leveling of the elevator car relative to a respective elevator landing may be accomplished via one or more sensor readings of magnets carried by the positioning tape and disposed at such landing. Secondly, the positioning tape may be formed without perforations. In this version of the tape, magnets may be disposed at each respective landing to be traversed by the elevator car, and may be read by sensors of the landing unit. This way, sensor readings may be obtained to determine both the respective landing position of the elevator car as well leveling thereof.

The above arrangements, however, may be impacted by a number of environmental and use constraints that decrease their ability to enable accurate leveling between an elevator and an intended landing. Environmentally, for example, the hoistway accommodating the positioning tape may be subject to settlement, thereby deteriorating the accuracy of any contributed measurement to be provided by sensor reading of perforations or magnets disposed along the positioning tape. Still further, the positioning tape may accumulate debris that may skew any ability to read its constituent perforations. In terms of constraints on use, one or more of the aforementioned veins may necessitate manual adjustment potentially resulting in skewed alignment with a respective landing. With respect to the aforementioned positioning tape, contact with the landing unit may impart frictional wear so as to cause the positioning tape to incur deterioration of either its constituent perforations and/or magnets. In either case, leveling of the elevator car with an intended landing may be unobtainable to such a degree so as to be impaired, and thus not permit appropriate travel into and out of the elevator cab.

Still further, the ability of the aforementioned arrangements to effectively contribute to the achievement of optimal elevator car leveling may be impacted by difficulties that may exist when attempting to maintain such arrangements. That is, each of such arrangements requires a technician's entry into the hoistway in order to inspect, repair, and/or replace either the aforementioned veins or the positioning tape. As a result, the availability of optimal elevator car leveling is subject to an ability to balance required operation of the elevator with the need to schedule and provide appropriate maintenance of those components which are necessary to obtain leveling with an intended landing.

Thus, it would desirable to provide for elevator car leveling that avoids the disadvantages discussed above. In other words, it would be desirable to enable such leveling in accordance with a mutual correspondence between the elevator car itself and an associated landing, and to do so at the transit area therebetween, i.e., independently of leveling apparatus(es) necessarily required to be disposed in the hoistway to enable accuracy in positioning and leveling. This way, such leveling may be achieved upon actual arrival of the elevator car at such landing, and without need to fully access the hoistway in order to render inspection and/or maintenance.

SUMMARY

It is to be understood that both the following summary and the detailed description are exemplary and explanatory and are intended to provide further explanation of the present embodiments as claimed. Neither the summary nor the description that follows is intended to define or limit the scope of the present embodiments to the particular features mentioned in the summary or in the description. Rather, the scope of the present embodiments is defined by the appended claims.

An embodiment may include an elevator alignment system, including a cab alignment member (CAM) configured to be disposed with an elevator car, and a landing alignment member (LAM) configured to be disposed with an elevator landing, wherein each of the CAM and the LAM provides a sensor and magnet array that is operative to indicate alignment of the elevator car with the elevator landing.

Another embodiment may include an elevator alignment system, including a cab alignment member (CAM) having an array of sensors and magnets, and configured to be disposed with an elevator car, and a landing alignment member (LAM) having an array of sensors and magnets, and configured to be disposed with an elevator landing, wherein each of the CAM and the LAM are configured to be laterally spaced from each other to respectively sense magnetic fields transmitted between the CAM and the LAM, the sensing of a lateral component M of the magnetic fields being operative to indicate an alignment of the elevator car with the elevator landing.

Another embodiment may include an elevator alignment system for an elevator car at an elevator landing, including a car alignment member (CAM) configured to be disposed with an elevator car sill of the elevator car, and a landing alignment member (LAM) configured to be disposed with a landing sill of the elevator landing, wherein each of the CAM and the LAM are operative to detect, via sensing at the elevator car sill and the landing sill, whether the elevator car is aligned with the elevator landing.

Another embodiment may include an elevator door restrictor, including a housing, a control disposed within the housing, and a locking cylinder configured to be actuated by the control between a retracted position from within the housing and a projected position external to the housing, each of the retracted position and the projected position being in response to the control receiving sensing of alignment at an elevator door sill and a landing sill.

In certain embodiments, the disclosed embodiments may include one or more of the features described herein.

BRIEF DESCRIPTION OF THE DRAWINGS

The accompanying drawings, which are incorporated herein and form a part of the specification, illustrate exemplary embodiments and, together with the description, further serve to enable a person skilled in the pertinent art to make and use these embodiments and others that will be apparent to those skilled in the art. Embodiments herein will be more particularly described in conjunction with the following drawings wherein.

DETAILED DESCRIPTION

Figure 1:
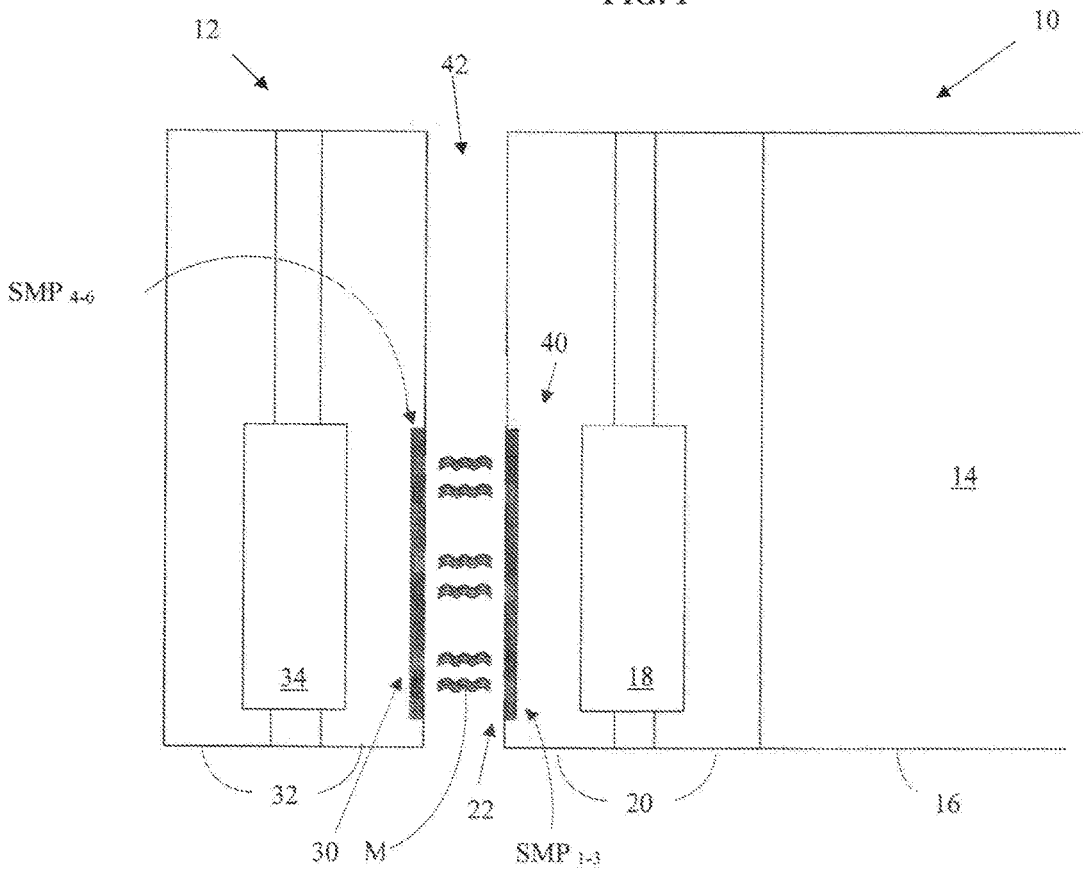
FIG. 1 is a plan view of alignment between an elevator car and a landing to which the elevator cab is scheduled, according to embodiments disclosed herein.

The present disclosure will now be described in terms of various exemplary embodiments. This specification discloses one or more embodiments that incorporate features of the present embodiments. The embodiment(s) described, and references in the specification to "one embodiment", "an embodiment", "an example embodiment", etc., indicate that the embodiment(s) described may include a particular feature, structure, or characteristic. Such phrases are not necessarily referring to the same embodiment. The skilled artisan will appreciate that a particular feature, structure, or characteristic described in connection with one embodiment is not necessarily limited to that embodiment but typically has relevance and applicability to one or more other embodiments.

In the several figures, like reference numerals may be used for like elements having like functions even in different drawings. The embodiments described, and their detailed construction and elements, are merely provided to assist in a comprehensive understanding of the present embodiments. Thus, it is apparent that the present embodiments can be carried out in a variety of ways, and does not require any of the specific features described herein. Also, well-known functions or constructions are not described in detail since they would obscure the present embodiments with unnecessary detail.

The description is not to be taken in a limiting sense, but is made merely for the purpose of illustrating the general principles of the present embodiments, since the scope of the present embodiments are best defined by the appended claims.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedure, Section 2111.03.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items. As used herein, the singular forms "a", "an" and "the" are intended to include the plural forms as well, unless the context clearly indicates otherwise.

The word "exemplary" is used herein to mean "serving as an example, instance, or illustration." Any embodiment described herein as "exemplary" is not necessarily to be construed as preferred or advantageous over other embodiments. Additionally, all embodiments described herein should be considered exemplary unless otherwise stated.

Figure 2:
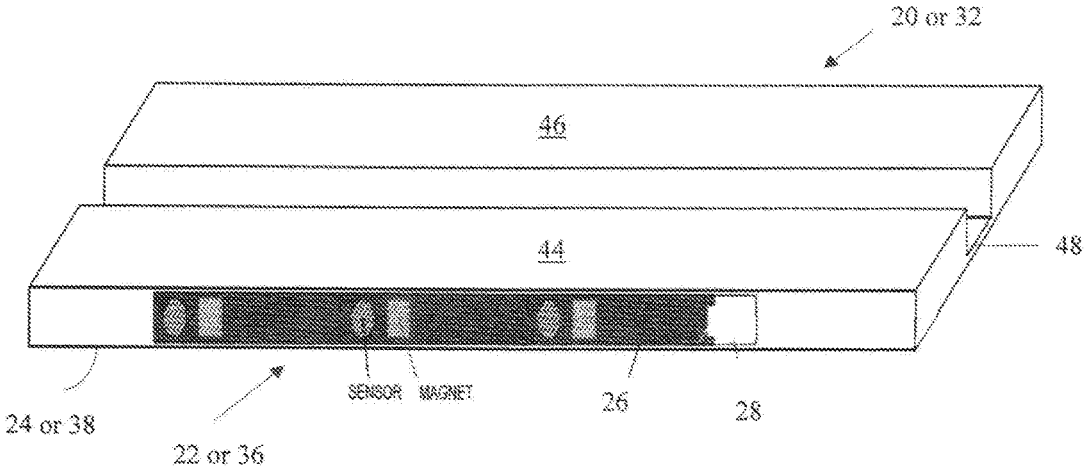
FIG. 2 is a perspective view of an elevator sill, of either the elevator car or landing of FIG. 1, according to embodiments herein.

Referring to FIGS. 1-2, there is illustrated an instance of alignment between an elevator 10 and a landing 12 to/from which the elevator 10 is scheduled. As shown, the elevator 10 defines a car having a cab 14, and a platform 16, in which the cab 14 is enclosed by a car door 18. The car door 18 may be disposed within and on a respectively associated car, i.e., elevator, sill 20. Defining a portion of the elevator sill 20 is a car alignment member (CAM) 22 disposed at a side face 24 of the elevator sill 20. One or more portions of the CAM 22 may be integrally formed in a one-piece construction of the elevator sill 20, or may be otherwise fitted with the elevator sill 20 once the elevator sill 20 is itself fully formed. In other words, one or more portions of the CAM 22 may be attachable and detachable from the elevator sill 20 so as to facilitate inspection and maintenance thereof. More specifically, the CAM 22 may include a printed circuit board (PCB) 26 having a microprocessor 28 therein and an array 30 of alternating sensors and magnets forming sensor/magnet pairs. It will be understood that, as used herein, the term "array" may mean any arrangement of a sensor and a magnet and/or any arrangement of multiple pairs of such a sensor and magnet, as discussed hereinafter. In an embodiment, three sets of sensor/magnet pairs (SMPs) may be disposed along a lengthwise dimension of the CAM 22, in which each sensor and each magnet of each pair are disposed in a side-by-side relationship. In another embodiment, the CAM 22 may include less than or more than three sets of the aforementioned SMPs. In any of these embodiments, the array of sensors and magnets disposes each thereof in an alternating manner such that a first magnet may be disposed adjacent to a sensor that may then be disposed adjacent to a second magnet of another SMP, etc., along a longitudinal axis of the CAM 22. In any such disposition of the SMPs, spacing between respective pairs of SMPs may or may not be present, and spacing between a respective sensor and a respective magnet of a SMP may or may not be present.

As is also shown in FIG. 1, in the instance in which the elevator 10 may be in alignment with the landing to/from which it may be scheduled is a hoistway, i.e., landing, sill 32. Disposed on and within the landing sill 32 is a landing door 34 allowing passage to and from the elevator 10, and specifically the cab 14 thereof. As will be understood, the elevator car door 18 may latch with the landing door 34 to cause each thereof to open or close together upon actuation of such respective movement. Similarly, as in the above-discussed CAM 22, a portion of the landing sill 32 may define a landing alignment member (LAM) 36 disposed at a side face 38 of the landing sill 32. One or more portions of the LAM 36 may be integrally formed in a one-piece construction of the landing sill 32, or may be otherwise fitted with the landing sill 32 once the landing sill 32 is itself fully formed. In other words, one or more portions of the LAM 36 may be attachable and detachable from the landing sill 32 so as to facilitate inspection and maintenance thereof. More specifically, the LAM 36 may include a printed circuit board (PCB) 26 having a microprocessor therein, similar to the CAM 22, and an array 40 of alternating sensors and magnets forming SMPs. In an embodiment, three sets of SMPs may be disposed along a lengthwise dimension of the LAM 36. In another embodiment, the LAM 36 may include less than or more than three sets of the aforementioned SMPs. In any of these embodiments, the array 40 of sensor and magnets disposes each thereof in an alternating manner such that a first sensor may be disposed adjacent to a magnet that is then disposed adjacent to a second sensor of another SMP, etc., along a longitudinal axis of the LAM 36. In any such disposition of the SMPs, spacing between respective pairs of SMPs may or may not be present, and spacing between a respective sensor and a respective magnet of a SMP may or may not be present.

When each of the elevator 10 and the landing 12 are aligned, as is shown in FIG. 1, the respective sills 20, 32 thereof dispose their array of sensor/magnet pairs in opposition to each other. That is, while each of the sills 20, 32 may be disposed apart from each other due to a gap 42 separating the elevator and landing sills 20, 32, a magnet defining the CAM 22 may be disposed directly across from a sensor defining the LAM 36. In this way, a magnetic field emanating from a given magnet of the CAM 22 and the LAM 36 may be sensed by a particular sensor of the other of the CAM 22 and the LAM 36 which may be disposed on an opposing side of the aforementioned gap 42 separating the elevator and landing sills 20, 32. For example, as is shown in FIG. 1, three sets of SMPs of each of the CAM 22 and the LAM 36, totaling six SMPs, cooperate respectively to emanate and sense magnetic fields thereof. In an embodiment, like that which is shown in FIG. 1, the CAM 22 may include, though not be limited to, $SMPs_{1-3}$, and the LAM 36 may include, though not be limited to, $SMPs_{4-6}$. As such, a magnetic field emanating from a given magnet of the CAM 22 and the LAM 36 may be sensed by the particular sensor of the other of the CAM 22 and the LAM 36 which may be both disposed directly across the gap 42 separating the elevator and landing sills 20, 32 and horizontally aligned with the emanating magnet. In an embodiment, at least two sets of SMPs may be operable to cooperate and produce an indication of alignment of the elevator and landing sills 20, 32 so as to backstop the situation in which failure of a third SMP may occur. Referring to FIG. 2, there is shown an exemplary elevator sill 20 or landing sill 32, which may be implemented with either the CAM 22 or the LAM 36. As shown, the sill 20 or 32 includes top surfaces 44, 46 separated by a groove 48 within which a car door 18 or landing door 34 may travel. As is also shown, the sill 20 or 32 may include the side face 24 or 38, respectively, within which the CAM 22 or the LAM 36 may be disposed in accordance with the discussion of FIG. 1 above. Each of the CAM 22 and the LAM 36 may be disposed flush with the side face 24 or 38 so as to not impede the clearance provided by the gap 42 separating the elevator and landing sills 20, 32. In this way, magnetic fields emanated by magnets of each of the CAM 22 and the LAM 36 may be unimpeded.

It will be understood that the CAM 22 and the LAM 36 may be configured with all appropriate hardware and/or software enabling selection and/or monitoring of on/off states of the SMPs, and to enable any sensor of any SMP to register detection of only a laterally received component M of a magnetic field, and wherein such component M has traveled at least the distance of the gap 42 separating the elevator and landing sills. In other words, such a sensor may be configured to register detection of the laterally received component M only if such component is propagated according to a predetermined time period that is necessary for propagation of the component M across the gap 42. Thus, if the spacing of the gap 42 is fixed (according to applicable code, etc.) a timing for the aforementioned propagation will likewise be fixed and known, based on a known magnet. This way, a sensor of, e.g., the CAM 22, may be configured to be blind to, and thus not detect, any component of any magnetic field of any magnet(s) included thereon the CAM 22. In these ways, each of the CAM 22 and the LAM 36 function as mutually cooperating sensory systems installed among the sills 20 and 32 to enable detection of alignment of the sills 20 and 32 relative to the gap 42.

In view of the above, it may be understood that embodiments herein contemplate that one or more of the CAM 22 and the LAM 36 may be alternatively configured with sensing apparatus(es) enabled to detect alignment among the elevator sill 20 and the landing sill 32. That is, instead of one or more the CAM 22 and the LAM 36 having SMPs functioning to measure magnetic component travel across gap 42, one or more other measurable media, such as, but not limited to, lighting, sound, temperature, and density may likewise provide for an exchange among the CAM 22 and the LAM 36 of sensor-detectable criteria for judging alignment among the sills 20 and 32. Still further, embodiments herein contemplate that one or more of CAM 22 and the LAM 36 may optionally include one or more wireless systems enabled to detect, and register with each other, alignment among the sills 20 and 32 according to the gap 42. Thus, such wireless systems may serve to replace the one or more of the SMPs of either the CAM 22 or the LAM 36, or may be provided in addition to the SMPs so as to verify operation thereof. Such wireless systems may, for instance, be configured to operate according to the Bluetooth Low Energy (BLE) protocol or other appropriate protocol providing communications within a commensurate range.

Figure 3:
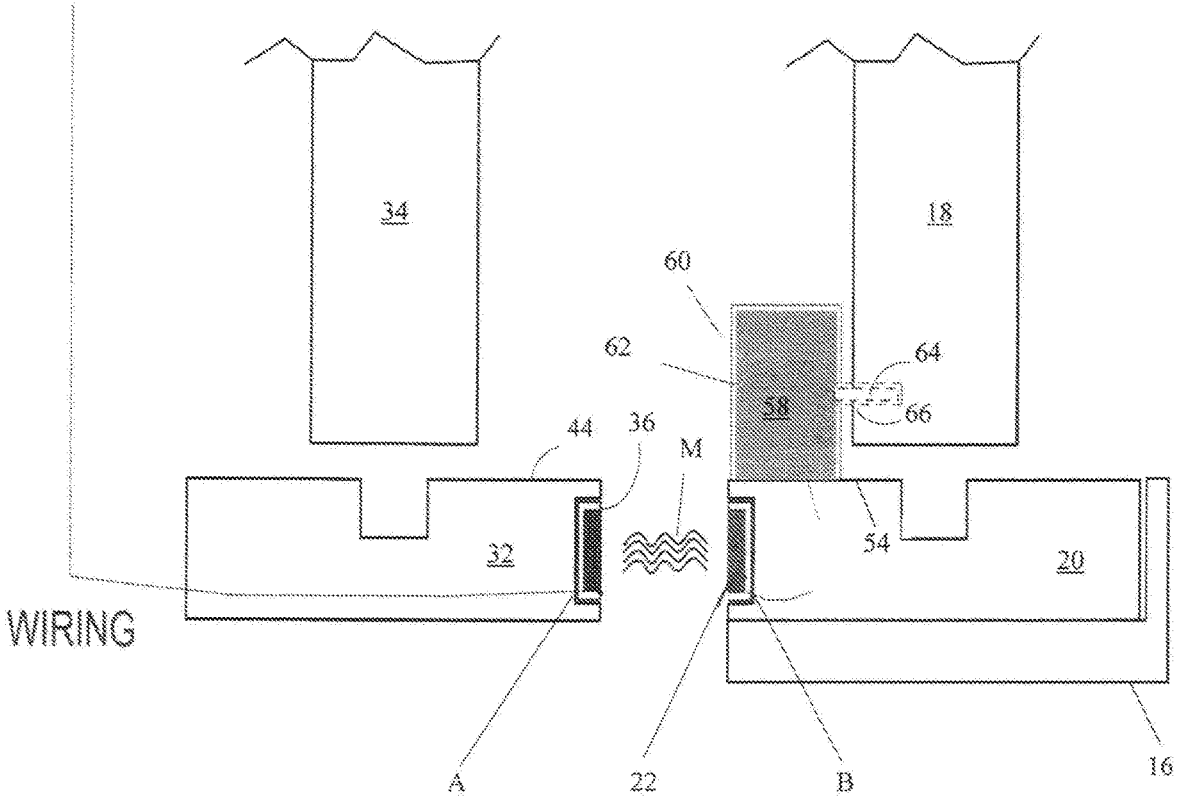
FIG. 3 is a side view of alignment between elevator and landing sills of FIG. 2 showing sectioning of respective elevator and landing doors at top portions thereof.

Referring to FIG. 3, FIG. 3 there is illustrated an instance of alignment between the elevator sill 20 and the landing sill 32, when viewed from the side (in which the side is perpendicular to the direction of entry into and exit from the elevator cab).

As shown in FIG. 3, the LAM 36 may be connected, via wired signal connection, at "A" to a main controller 50 disposed in a motor room 52 atop the hoistway. As is understood, the main controller 50 controls various mechanical linkages to either open or close each of the elevator and landing doors 18, 34 in response to an appropriate signaling carried by the aforementioned connection. In embodiments, such signaling comprises sensing by at least a first and a second sensor of the LAM 36 of the directly and laterally transmitted component M of the magnetic field respectively emanated by each of at least a first and a second magnet of the CAM 22. That is, the aforementioned sensing may be indicative of a degree of alignment in which respective elevator and landing sill top surfaces 54 and 44 are registered with each other within a degree of tolerance permitted by applicable building code.

Figure 4:
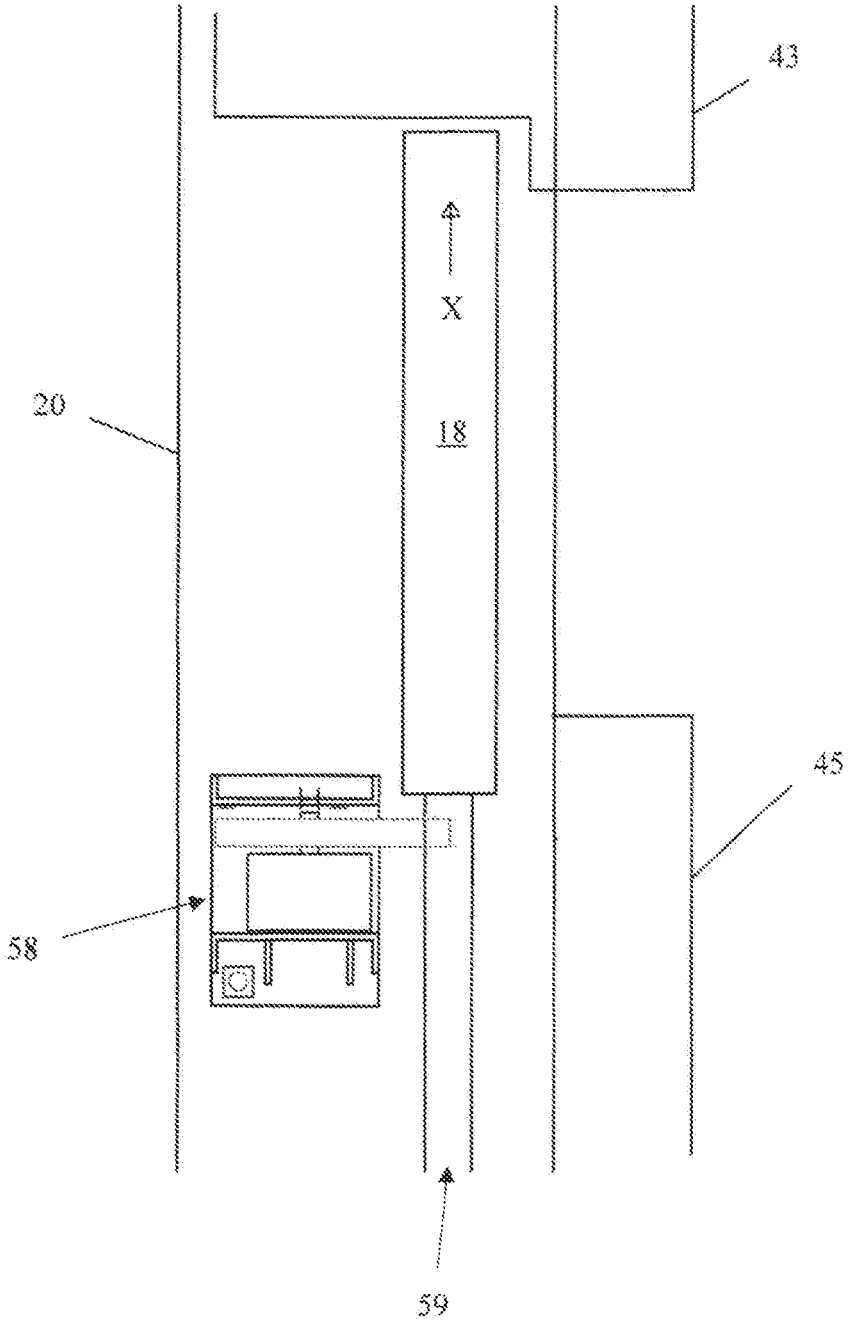
FIG. 4 is a partial plan and environmental view of a door restrictor positioned with the elevator sill of FIG. 1 and that is operable in response to alignment between each of the elevator and landing sills of FIG. 1.
Figure 5:
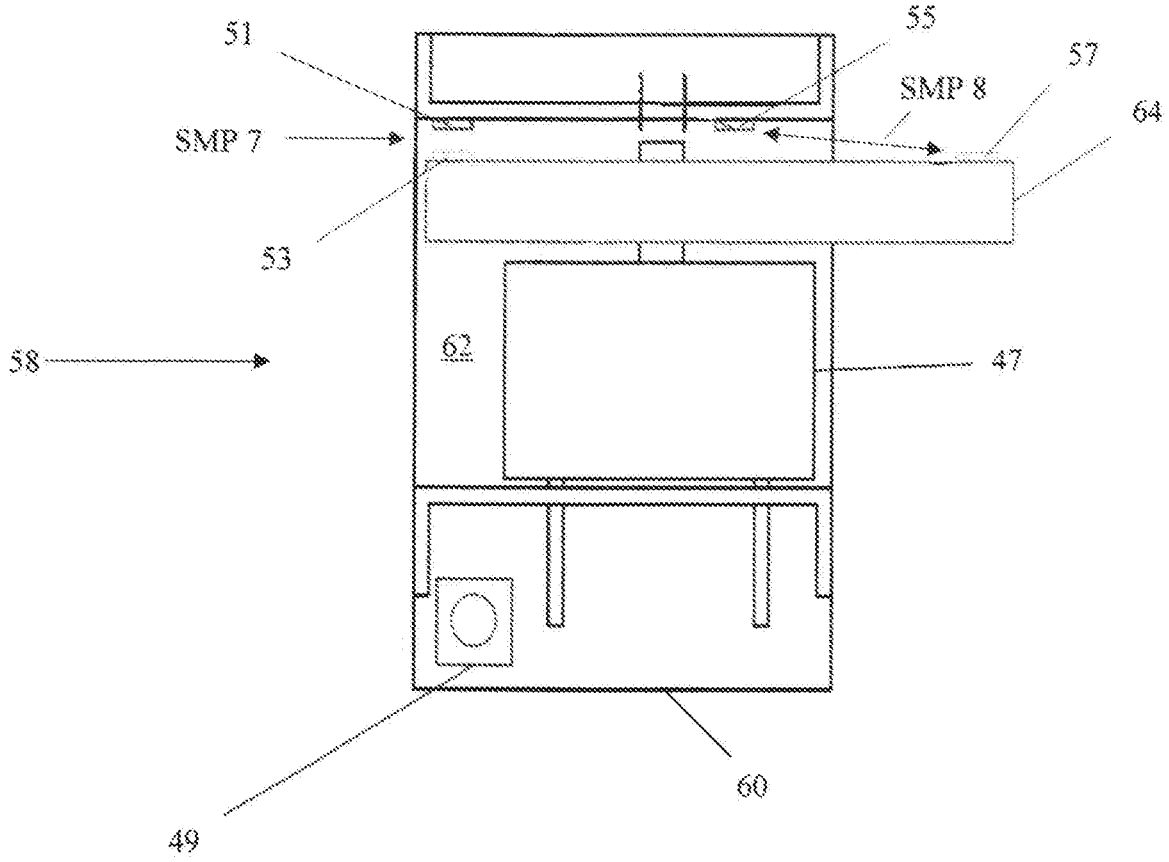
FIG. 5 is a partial plan view of the door restrictor of FIG. 4.
Figure 6:
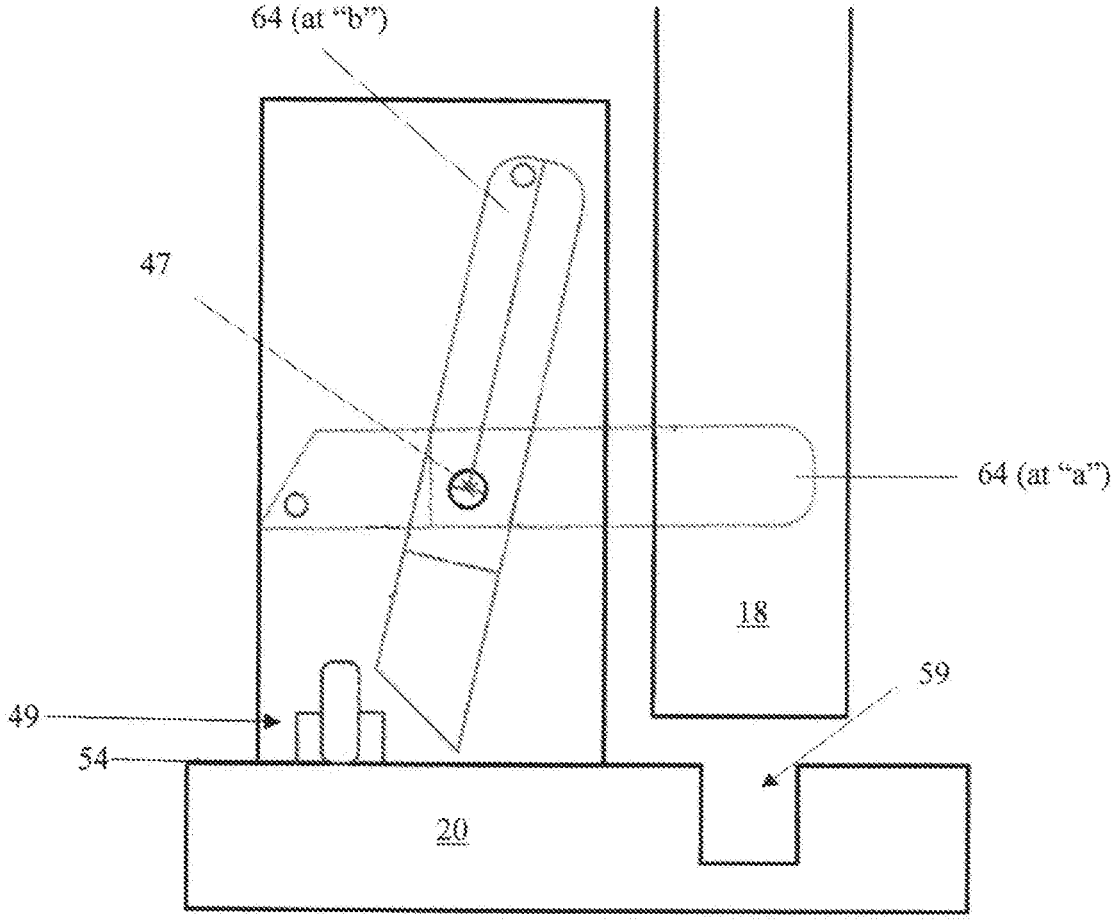
FIG. 6 is a side and perspective view of the door restrictor of FIG. 4, showing relative movement of a locking cylinder thereof.

Referring to FIGS. 3-6, the CAM 22 may be connected, via wireless or wired signal connection at "B," to a door restrictor 58 fixedly connected to the top surface 54 of the elevator sill 20 and adjacent to a groove thereof 59 in which the car door 18 travels when opening or closing. More specifically, and as shown in FIG. 4, the door restrictor 58 may be disposed on the elevator sill 20 away from a strike jamb 43, and behind each of the cab door 18 and a return panel 45 of the elevator 10. As such, the restrictor 58 may be disposed out of view when the car door 18 is opened, or closed (after traveling in the shown direction "X" toward the strike jamb 43), so as to deter unintended manipulation thereof. The restrictor 58 comprises a housing 60 including a control 62 therein comprising all appropriate hardware and/or software which is operative to receive signaling from the CAM 22 that the elevator sill 20 and the landing sill 32 are or are not aligned, as discussed above. The control 62 may include a rotary solenoid 47, see FIGS. 5-6, for actuating a locking cylinder 64 comprising a rocker arm operatively connected with the rotary solenoid 47 and storable by the housing 60. The rotary solenoid 47 may cause the locking cylinder 64 to be rotated and extended substantially in parallel with the top surface 54 of the elevator sill 20 (i.e., perpendicular to a longitudinal axis of the sill 20) and within an aperture 66 of the car door 18 (shown in dashed lines in FIG. 3) when the elevator and landing sills 20, 32 are not aligned, see, e.g., FIG. 4. However, in response to the CAM 22 sensing alignment among the sills 20, 32, and such sensing being transmitted to the control 62, the control 62 may cause the solenoid 47 to rotate the locking cylinder 64 so as to be stored within the housing 60, through movement from a first, locked position "a" to second, unlocked position "b," as shown in FIG. 6, to enable latched movement of the car door 18 together with the landing door 34. Since the locking cylinder 64 may be disposed in a vicinity of the top surface 54 of the elevator sill 20 and projected within the car door 18 when alignment between the elevator and landing sills 20, 32 may not exist, the restrictor 58 may retard or prevent an ability to tamper with a closed state of the car door 18. In other words, the aforementioned disposition of the restrictor 58 and its locking cylinder 64 may thwart any attempt to force an opening of the car door 18 when alignment between each of the elevator and landing sills 20, 32 may not exist. Still further, the control 62 may be configured to sound an alarm should the locking cylinder 64 experience a forcible retraction from the car door 18 that is not actuated by the solenoid 47 in response to sensed alignment by the CAM 22.

Moreover, the restrictor 58 may include a series of tamper-aware sensors configured to cause the control to signal a transmittable (e.g., audible and/or lighted) alarm warning of tampering with the restrictor 58. To do so, optionally three or more sensors may be provided. First, the restrictor 58 may include a fixation sensor 49 configured to continually detect a fixed distance from the sensor 49 to the elevator sill 20. Should the detection be interrupted, the control 62 may then be triggered to signal the aforementioned alarm warning to indicate that the restrictor 58 has incurred an unintended displacement from the elevator sill 20. Second, the restrictor 58 may include $SMPs_{7-8}$ to thwart unintended tampering with the locking cylinder 64 itself. In this regard, and as shown in FIG. 5 (which illustrates an instance in which the locking cylinder 64 is engaged at position "a" in response to the elevator and landing sills 20, 32 being out of alignment), $SMP_7$ may include a locking cylinder 64 positional sensor 51 positioned within an interior of housing 60 and opposite a magnet 53 disposed on an end of the locking cylinder 64 that is distal from the elevator car door aperture 66. As shown in FIG. 6 (which illustrates an instance in which the locking cylinder 64 is disposed at position "b" in response to the elevator and landing sills 20, 32 being aligned), $SMP_8$ may include a locking cylinder 64 positional sensor 55 disposed distal to the sensor 51 and opposite a magnet 57 that is distal from the magnet 53 of $SMP_7$. As such, $SMP_7$ may provide, through sensor detection of the magnet 53, confirmation of whether locking cylinder 64 is appropriately maintained at its position "a." If position "a" is not maintained, sensor 51 may be configured to alert the control 62 to signal an alarm indicating the displacement. Likewise, $SMP_8$ may provide, through sensor detection of the magnet 57, confirmation of whether locking cylinder 64 is appropriately maintained at its position "b." If position "b" is not maintained, sensor 55 may be configured to alert the control 62 to signal an alarm indicating the displacement. In these ways, an awareness of unintended removal or manipulation of locking cylinder 64 with respect to positions "a" and/or "b" may be provided so as to ensure continued operation of the restrictor 58 to appropriately permit operations for opening or closing of the car and elevator doors 18 and 34 that result from alignment among elevator and landing sills 20, 32, as described herein.

Thus, with respect to its above-described positioning and inclusion of tamper-aware sensors, the restrictor 58 may be configured to deter not only its own abnormal operation, but also potentially resultant abnormal operation of controlled opening or closing of the car and elevator doors 18 and 34 according to alignment of the elevator and landing sills 20, 32.

Figure 7:
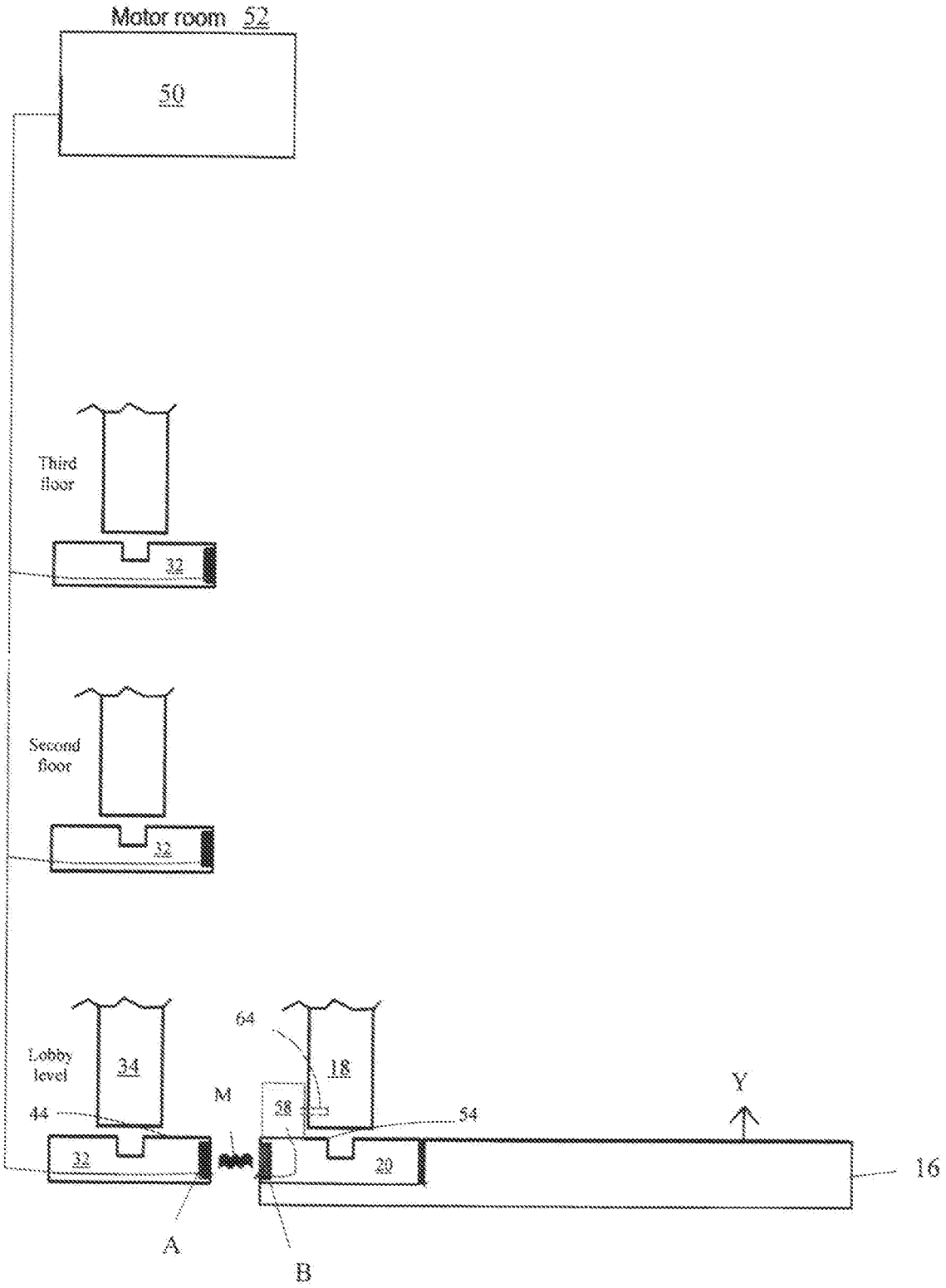
FIG. 7 is a schematic view diagrammatically showing progression of an elevator between intended landings of a building.

Referring to FIG. 7, there is illustrated an exemplary, intended progression of the elevator 10 among floors of a building and within the hoistway thereof, as indicated by arrow "Y." As shown in FIG. 3, each of the landing and car doors 34, 18 are shown in a state of alignment permitting entry into and exiting from the elevator 10, relative to respective sill top surfaces 44, 54. In such state, the locking cylinder 64, as mentioned above, may be retracted from the car door 18 so long as the state of alignment is maintained. Yet, as the car door 18 closes and the elevator 10 initiates travel among separate floors of the building, as in, for example, the indicated second and third floors as shown in FIG. 7, the locking cylinder 64 may be disposed with the car door 18 in response to the landing and elevator sills 20, 32 becoming unaligned.

As shown, each of the LAMs 36 of the second and third floors may be connected, via wired signal connection, to the main controller 50. As a result, as the elevator 10, and more specifically its sill 20 and constituent CAM 22 become aligned with the sill 32 and LAM 36 of the various, respective floors, the sensing of such alignment may be transmitted to (1) the main controller 50 to enable latched release/opening of each of the elevator car door 18 and the landing door 34 in conjunction with (2) disengagement, via the control 62, of the restrictor 58 from the car door 18.

Thus, as may be understood from the above, there is provided a system for indication of alignment of an elevator with respect to an intended landing. As has been discussed, such a system includes cooperation among constituent alignment members of each of the elevator and landing sills upon arrival of the elevator at the aforementioned intended landing. Because of such alignment, smoothened entry and exiting from the elevator may be facilitated. Furthermore, since alignment among the sills effects a trigger for release of the restrictor, and also latching of the landing and cab doors to allow their combined opening, an instance in which the landing door may be unintendedly opened without the elevator being present at a particular landing may be avoided. This is the case since presence of the elevator at a respective elevator landing is required, under normal operating conditions, to effect the opening of the landing door and to achieve the above-discussed latched opening.

As may be also understood, the system may further facilitate inspection and maintenance thereof since each of the elevator and landing sills may be detached at a respective landing, thus avoiding the need to conduct such operations entirely within an elevator hoistway.

Although the present embodiments have been described in detail, those skilled in the art will understand that various changes, substitutions, variations, enhancements, nuances, gradations, lesser forms, alterations, revisions, improvements and knock-offs of the embodiments disclosed herein may be made without departing from the spirit and scope of the embodiments in their broadest form.

What is claimed is:

1. An elevator alignment system, comprising:

a car alignment member (CAM) configured to be disposed with an elevator car;

a landing alignment member (LAM) configured to be disposed with an elevator landing, wherein each of the CAM and the LAM comprises a sensor and magnet array that is operative to indicate alignment of the elevator car with the elevator landing.

2. The elevator alignment system of claim 1, wherein:

the CAM is configured to be disposed with a sill of the elevator car.

3. The elevator alignment system of claim 2, wherein:

the LAM is configured to be disposed with a sill of the elevator landing.

4. The elevator alignment system of claim 3, wherein:

the CAM is configured to be disposed with a side face of the sill of the elevator car.

5. The elevator alignment system of claim 4, wherein:

the LAM is configured to be disposed with a side face of the sill of the elevator landing.

6. The elevator alignment system of claim 5, wherein:

the CAM and the LAM each form a one-piece construction with their respective sill.

7. The elevator alignment system of claim 1, wherein:

each sensor and magnet array is disposed along a longitudinal direction of the CAM and the LAM.

8. The elevator alignment system of claim 7, wherein:

each sensor and magnet array comprises a plurality of sensor/magnet pairs (SMPs).

9. The elevator alignment system of claim 8, wherein:

at least two SMPs of each of the CAM and the LAM are operative to indicate alignment of the elevator car with the elevator landing.

10. An elevator alignment system, comprising:

a car alignment member (CAM) comprising an array of sensors and magnets, and configured to be disposed with an elevator car; and a landing alignment member (LAM) comprising an array of sensors and magnets, and configured to be disposed with an elevator landing, wherein each of the CAM and the LAM are configured to be laterally spaced from each other to respectively sense magnetic fields transmitted between the CAM and the LAM, the sensing of the magnetic fields being operative to indicate an alignment of the elevator car with the elevator landing.

11. The elevator alignment system of claim 10, wherein:

each array of sensors and magnets is disposed along a longitudinal direction of the CAM and the LAM.

12. The elevator alignment system of claim 11, wherein:

each array of sensors and magnets comprises a plurality of sensor/magnet pairs (SMPs).

13. The elevator alignment system of claim 12, wherein:

a sensor of the CAM is disposed laterally opposite a magnet of the LAM.

14. The elevator alignment system of claim 13, wherein:

at least two SMPs of each of the CAM and the LAM are disposed laterally opposite each other, and are operative to indicate alignment of the elevator car with the elevator landing.

15. The elevator alignment system of claim 14, wherein:

the at least two SMPs of the CAM are configured to be disposed with an elevator sill of the elevator car, and the at least two SMPs of the LAM are configured to be disposed with a landing sill of the elevator landing.

* * * * *